US006475123B1

(12) United States Patent
Evans

(10) Patent No.: US 6,475,123 B1
(45) Date of Patent: Nov. 5, 2002

(54) ABDOMINAL WEIGHT LIFTING APPARATUS AND METHOD

(76) Inventor: Layne W. Evans, 10905 Bohm Pl., Sandy, UT (US) 84094

( * ) Notice: Subject to any disclaimer, the term of this patent is extended or adjusted under 35 U.S.C. 154(b) by 0 days.

(21) Appl. No.: 09/684,743

(22) Filed: Oct. 4, 2000

(51) Int. Cl.[7] ..... A63B 21/06

(52) U.S. Cl. ..... 482/97; 428/137; 428/140; 428/130

(58) Field of Search ..... 482/99, 100, 137, 482/97, 130, 142, 141, 138, 133, 140

(56) References Cited

U.S. PATENT DOCUMENTS

| | | | | |
|---|---|---|---|---|
| 4,372,553 A | | 2/1983 | Hatfield | 272/119 |
| 4,387,893 A | | 6/1983 | Baldwin | 272/118 |
| 4,729,562 A | | 3/1988 | Pipasik | 272/117 |
| 5,106,079 A | * | 4/1992 | Escobedo et al. | 482/97 |
| 5,368,537 A | | 11/1994 | Felice | 482/140 |
| 5,545,114 A | * | 8/1996 | Gvoich | 482/140 |
| 5,599,261 A | * | 2/1997 | Easley et al. | 482/130 |
| 5,616,109 A | | 4/1997 | Szu-Ming | 482/123 |
| 5,665,041 A | * | 9/1997 | Hsieh | 482/140 |
| 5,702,332 A | * | 12/1997 | Hsieh | 482/130 |
| 5,722,923 A | | 3/1998 | Lui | 482/140 |
| 5,803,884 A | | 9/1998 | Sharp | 482/142 |
| 6,015,372 A | | 1/2000 | Steffee | 482/137 |
| 6,206,808 B1 | | 3/2001 | Ho | 482/95 |
| 6,206,809 B1 | * | 3/2001 | Habing et al. | 482/96 |

* cited by examiner

*Primary Examiner*—Jerome W. Donnelly

(57) ABSTRACT

A method and apparatus for exercising the abdominal muscles where the exerciser is laying on his backside and the exercisers middle and upper spine as well as head are dynamically supported when exercising. The exercise is accomplished as the upper-torso support moves forward and upward, then rearward and downward through exertion of the abdominal muscles. The lumbar-end of the upper-torso support is secured to a pivot-point. This axis is directly supporting the center of the lumbar region. Resistance is provided by weight plates mounted on the head-end of the support for the upper-torso. The upper-torso support at the head-end is connecting to a lever. The lever is connected to handles and resistance pads engageable by the exerciser's hands and forearms respectively. The upper-torso support and the exerciser's upper-torso move forwardly and upwardly to perform positive work and rearwardly and downwardly to perform negative work. Respectively, the handles and resistance pads move forward and toward the exercisers lower-body during positive work and rearward and away from the exercisers lower-body during negative work.

11 Claims, 5 Drawing Sheets

ABDOMINAL WEIGHT LIFTING APPARATUS AND METHOD

BACKGROUND OF INVENTION

The present invention generally relates to methods and apparatus for exercising the abdominal muscles.

In the past there have been quite a variety of exercise apparatus available for exercising the abdominal muscles. One such apparatus includes an adjustable slant board with a pad for holding a user's feet in place while sit-ups and crunches are performed. Another abdominal exercise apparatus supports the upper half of a user's body while in a reclined position on the floor. This apparatus also has arm, head and neck pads for supporting a user's arms, head and neck respectively. This apparatus has curved rocker components in contact with the floor. To exercise the abdominal muscles, the user does regular abdominal crunches aided by the fact that the apparatus rocks back and forth. Also available are machines in which a user sits. Many of these apparatus have upper torso supporting means that include pads posterior the upper torso. Others have resistance pads anterior and adjacent the user's chest. The exerciser presses his chest forward and downward to move the pad and activate the resistance mechanism.

All of the abdominal exercise apparatus mentioned here, and many, many not mentioned have one very important fault in common. The abdominal exercise movement rotates about an axis generally along a line passing through the user's body below and adjacent the sternum. The adjustable slant board has an axis adjacent the sternum plane. The conventional rocking apparatus has an axis adjacent the sternum plane. The seated apparatus with posterior torso support has an axis adjacent the sternum plane. One such apparatus, U.S. Pat. No. 4,387,893 states in it's claims that it has an object to accomplish exercising movement about an axis along a line passing through the user's body below and adjacent the sternum plane. And other seated apparatus with resistance pads anterior and adjacent the exerciser's chest have the same general location of axis.

Simply stated, because the pivotable axis is near the sternum plane the abdominal muscles near the sternum are the ones which lengthen and shorten and move isokenetically. The abdominal muscles near the sternum are the upper one-third of the abdominal wall. These upper abdominal muscles get the majority of the benefit because they do the majority of the work. The lower portions of the abdominal wall do not lengthen and shorten during abdominal exercise using prior art apparatus. They flex and relax without much movement. They perform isometrically instead of isokenetically. Isometric is vastly inferior to isokenetic in its power to improve muscle condition as well as appearance. Therefore, an important fault of the prior art is an axis that is poorly located. This faulty axis can create underdeveloped middle and lower abdominal wall regardless of how many dedicated hours the exerciser works.

A further and very important negative result of the faulty axis of the prior art is its negative effect on the exerciser's posture. The old adage that how one practices determines how one performs tells us something ominous about prior art abdominal exercise apparatus. Imagine an exerciser spending day after day, week after week building abdominal strength through a range of motion about an axis along a line passing through the user's body below and adjacent the sternum. That exerciser is building up performance habit in the crunch position, upper abs shortened, middle back bent forward at the sternum plane. Now, transpose the described spine-posture onto a person standing and lifting. In other words, standing and lifting with middle back bent forward at the sternum plane. This described position is the very same position millions of people in our society get into. For millions of people the result is serious and permanent injury to their back by herniating discs. Lifting something heavy doesn't cause this kind of injury as long as healthful spine alignment is maintained during the lift. The injury results when the posture assumed during the lifting is bent forward at the middle back with shortened upper abdominals. Prior art apparatus promote such posture.

In summary, the above mentioned apparatus of the prior art are far less than ideal because they fail to provide optimal development for middle abdominal muscles. Also, prior art apparatus are less than ideal because the postural performance habit they promote in the exerciser's middle spine is the same one usually present when so many millions of people injure their backs.

OBJECTS OF INVENTION

The present invention seeks to overcome the above noted deficiencies of prior-art abdominal machines and methods while also providing other improvements. It is therefore an object of the present invention to provide novel and improved methods and apparatus for exercising the abdominal muscles of the human body.

Included herein is abdominal exercise apparatus with new and better features including providing a user with a dynamic upper-body support component supporting the torso posteriorly including head, shoulder blades, upper spine down to lumbar. The dynamic upper-body support component moves with axis of movement at lumbar transverse the umbilical plane. This inventions umbilical plane axis is new with unexpected benefits including constant and safe spine alignment from head to lumbar. This spine alignment promotes healthful long-abdominal posture with no excess bending at the middle spine. There is never any bending at the sternum plane with this invention. Thus this invention promotes ideal posture which is far less prone to result in spinal injury compared to prior art abdominal exercise apparatus.

Further benefits and advantages include targeting the middle one-third of the abdominal muscles, adjacent the umbilical, as the primary and direct performer of movement. This invention establishes the lumbar, transverse the umbilical plane, as the axis, the corresponding abdominal muscles near the umbilical become the prime movers. Now with this invention the middle abdominal muscles no longer are isometric, flexing without movement. With this invention the middle abdominal muscles are isokenetic, lengthening and shortening against significant resistance. The result is that now, improvements of the middle abdominal muscles are accelerated compared to prior art apparatus. Accelerated improvements include overall muscle condition and appearance.

One preferred embodiment of the invention includes an arm component with lever attached to upper torso support means. This component allows the user's upper body strength to assist the abdominal muscles in the process of moving the entire upper torso and the upper torso support means at the axis of the lumbar transverse the umbilical plane. The arm component makes the placement of the axis at the lumbar transverse the umbilical plane possible. Without the arm component the exerciser would be unable to lift at the described axis. Further advantages of the arm component with lever include providing needed assistance allowing those with little abdominal strength to perform this innovative abdominal exercise without difficulty. This method and approach to abdominal muscle exercise is believed entirely new. The results are exceptionally positive for the abdominal muscles as well as the closely related spine.

BRIEF DESCRIPTION OF DRAWINGS

Some of the objects of the invention having been stated, other objects will appear as the description proceeds, when taken in connection with the accompanying drawings, in which

FIG. 6 is a perspective profile view of an exercise apparatus in accordance with the present invention with an exerciser positioned on the apparatus illustrating the method of exercise.

DETAILED DESCRIPTION OF INVENTION

While the present invention will be described herein after with particular reference to the accompanying drawings, in which an operating embodiment of the apparatus of the present invention is shown, it is to be understood at the outset of the description which follows that it is contemplated that apparatus and methods in accordance with the present invention maybe varied from the specific form described hereinafter while still attaining the desired result of this invention. Accordingly, the description which follows is to be understood as a broad teaching disclosure directed to persons of appropriate skill in the appropriate art, and not as limiting upon the scope of this invention.

Figure 3:
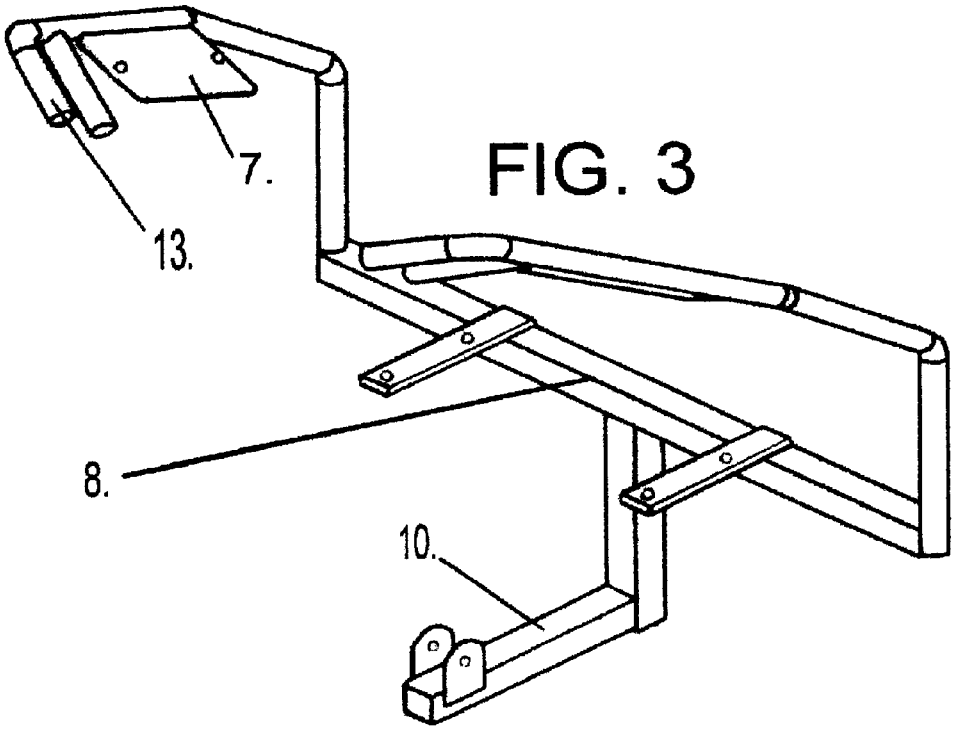
FIG. 3 is a perspective view of one component of a preferred embodiment of the present invention—an arm component.
Figure 4:
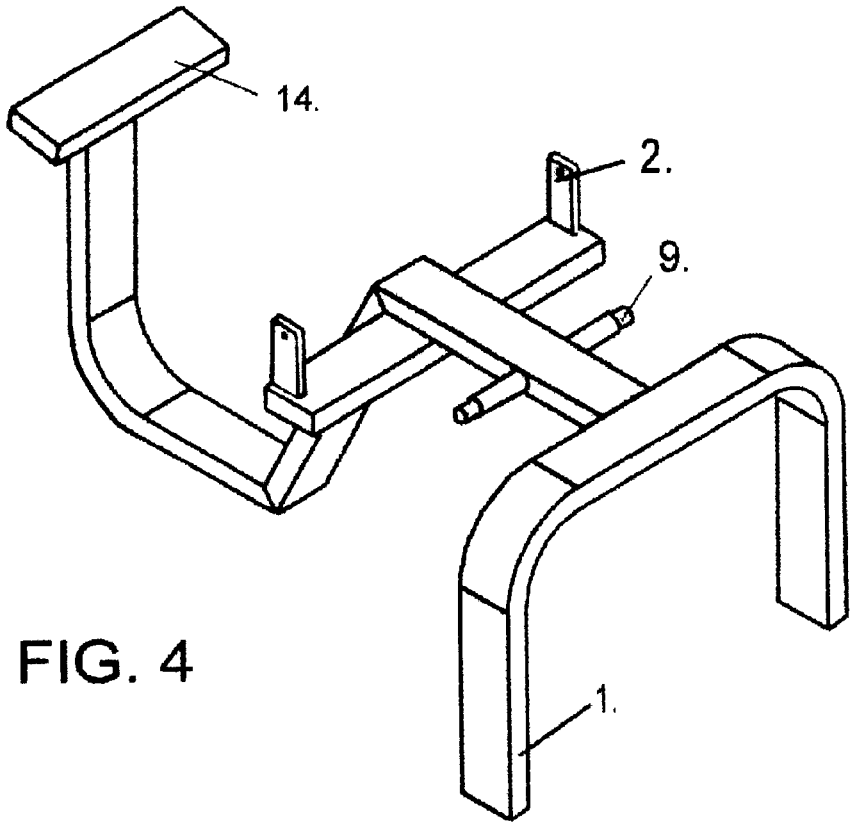
FIG. 4 is a perspective view of one component of a preferred embodiment of the present invention—a frame.

Referring now more particularly to FIGS. 1 through 6, an apparatus for exercising abdominal muscles in accordance with the present invention is here shown. The apparatus includes a frame structure preferably fabricated from steel tubing and generally indicated at 1. In FIG. 4, the frame 1 is shown with ancillary components removed. Mounted brackets provide the axis of components for supporting the user posteriorly 2. The lumbar support component 3 is mounted on the axis of components for supporting the user posteriorly 2. The lumbar support component comprises a horizontal rod of steel encased in a foam pad roller encased in vinyl material sewn and mounted.

The hip support component 4 is attached at its lumbar end to the axis of components for supporting the user posteriorly 2. The hip support component 4 is comprised of vinyl cloth, wrapped and stapled over foam pad, mounted to a plywood base large enough to support a large adult, bolted to steel tubing. The hip support component 4 is attached at the buttock end to the support post 6 with bolt, nut, washers and lock washers. The lower end of the support post 6 is welded to frame 1.

The upper torso component 5 is attached at its lumbar end to the axis of components for supporting the user posteriorly 2 with ball bearing assembly. The upper torso component 5 is comprised of vinyl cloth, wrapped and stapled over foam pad, mounted to a plywood base bolted to steel tubing and large enough to support the upper torso of a large person posteriorly. At the head end of upper torso component 5 is the weight receiver 12. The weight receiver 12 can be loaded with Olympic weight plates to increase resistance, and Olympic weight plates can be unloaded from weight receiver 12 to decrease resistance.

The arm component 8 (FIG. 3) has handles above and anterior to users chest. The arm component 8 includes rubber grips mounted to two pair of handles 13, two higher for taller users, two lower for shorter users. The arm component 8 has forearm pads 7 for receiving the user's forearms. The forearm pads 7 of the arm component 8 are comprised of vinyl cloth wrapped and stapled over foam cushions mounted to plywood, bolted to steel and they are large enough to engage a large persons forearms and situated to engage small or large forearms. The arm component 8 is mounted to the arm component axis 9 (FIG. 4) using ball bearing assembly. The opposite end of the arm component 8, the end away from the user's hands is the lever 10 (FIG. 3). The lever 10 is mounted to the connecting rod 11 (FIG. 8) using ball bearing assembly. The connecting rod 11 is also connected to the bottom of the head-end of the upper torso support 5 using ball bearing assembly.

Figure 1:
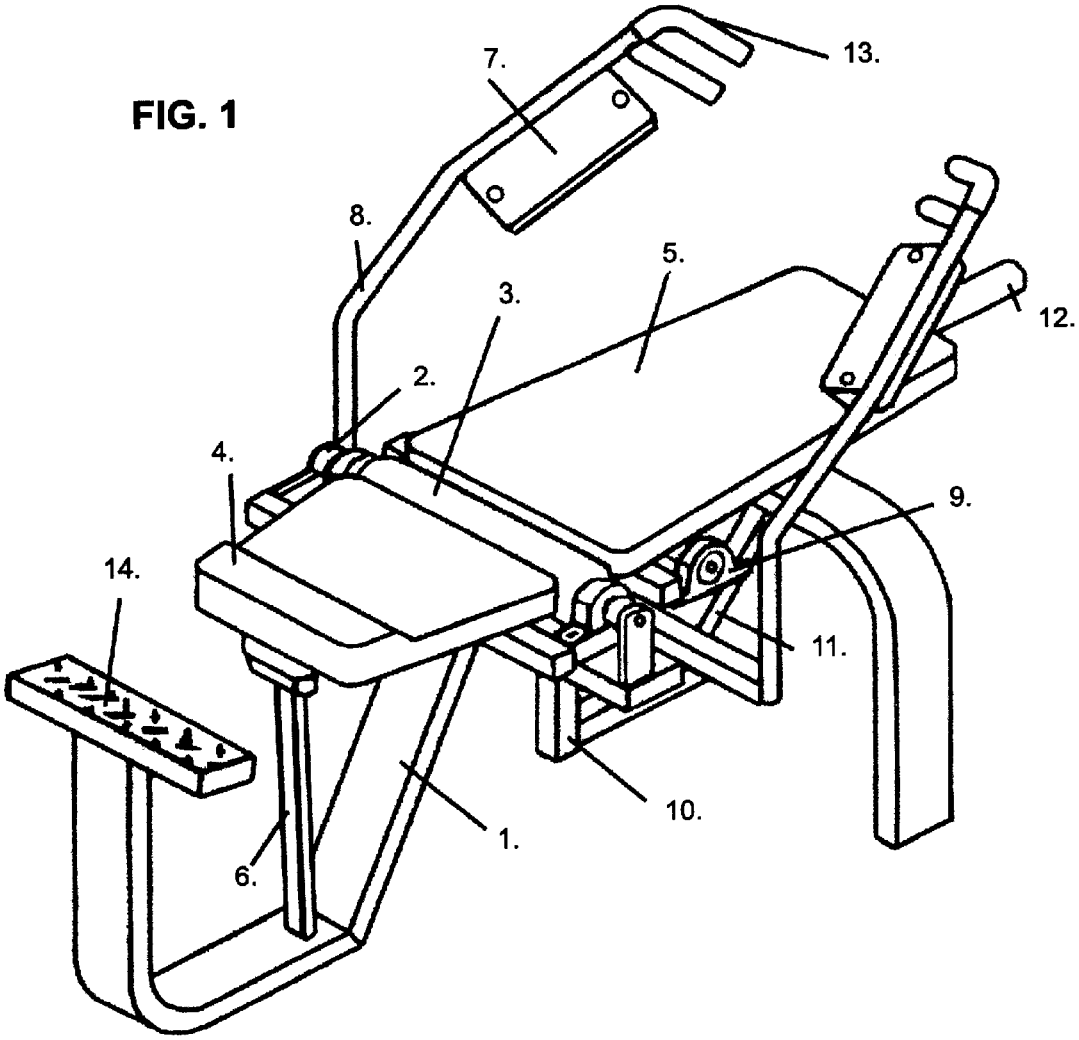
FIG. 1 is a perspective view of an abdominal muscle exercise apparatus or machine constituting a preferred embodiment of the present invention.
Figure 2:
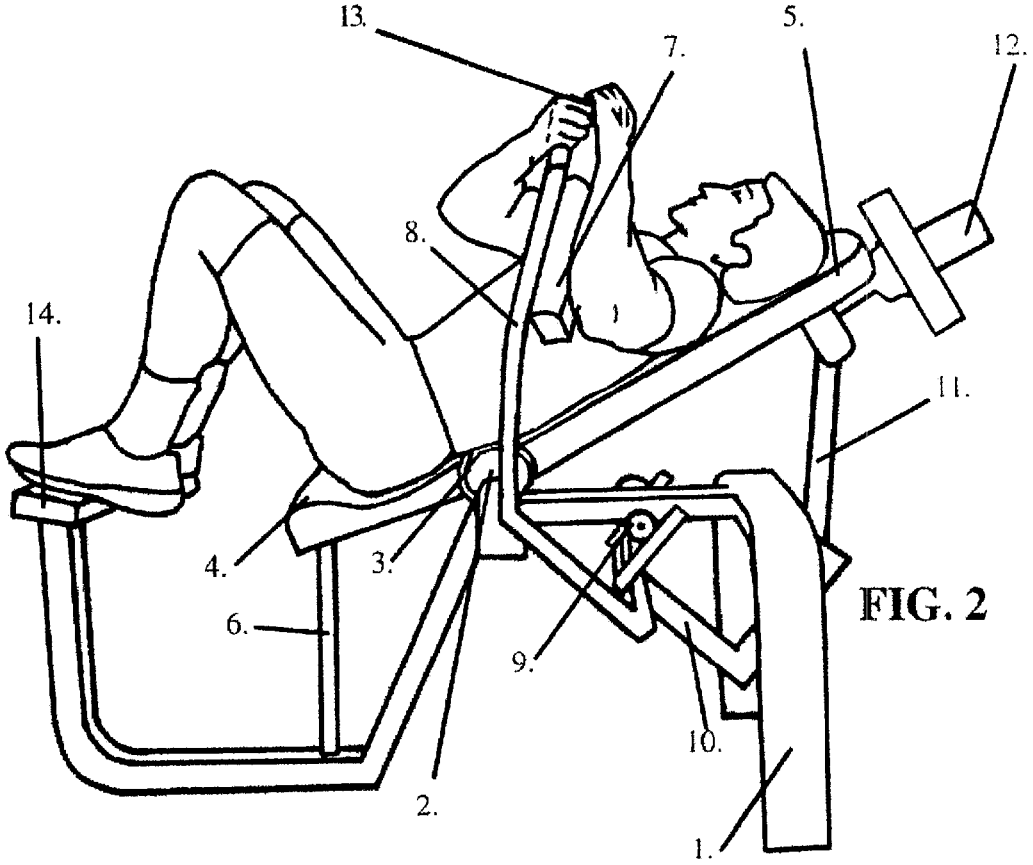
FIG. 2 is a perspective view of a preferred embodiment of the present invention with an exerciser positioned on the machine with both hands grasping one handle targeting the exercise to work the oblique muscles on the sides of the abdomen.

The foot station 14 is comprised of a diamond plate mounted to the frame as shown in FIG. 1 using button head bolts.

Figure 5:
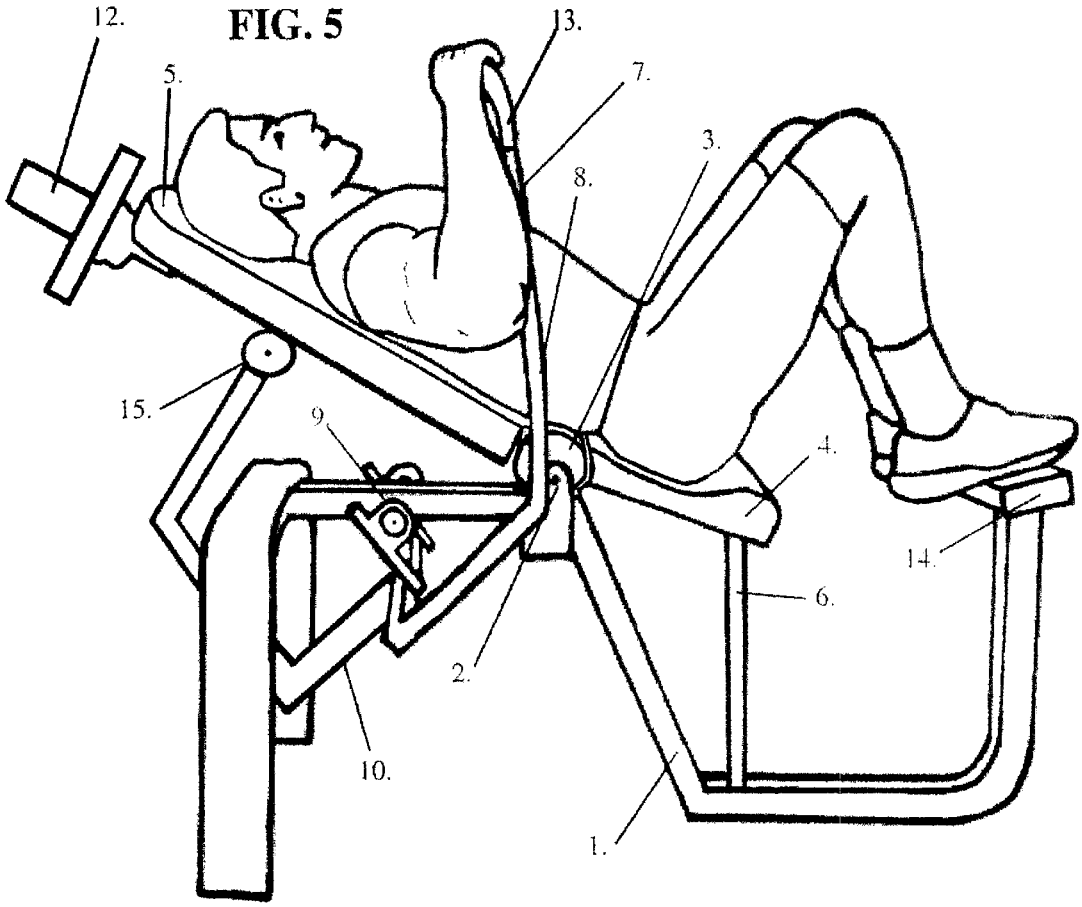
FIG. 5 is a perspective view of an abdominal muscle exercise apparatus or machine constituting a preferred embodiment of the present invention with one ramification. Instead of a connecting rod between the lever of the arm component and the upper torso supporting means, this drawing has a wheel rolling on the backside of the torso supporting means.

The preferred embodiment of the present invention uses an arm component 8, a lever 10, and an upper torso component 5 as previously described. However, one obvious ramification is shown in FIG. 5. In this example the upper torso component 5 is moved not by a connecting rod 11 but rather by a wheel 15 rolling freely up the backside of the upper torso component. The wheel 15 is attached to the lever 10 by conventional means.

OPERATION OF THE INVENTION

FIG. 9 shows an exerciser using the apparatus. To use the apparatus, an exerciser first chooses the amount of resistance by sliding olympic plates onto the weight receiver 12. Next the exerciser lays on the posterior support components as shown in FIG. 9 with the lumbar support 3 positioned supporting the lumbar generally under the umbilical plane, the hips on the hip support 4, the upper torso on the upper torso support 5, the hands grasping the arm component handles 13 and the forearms against and behind the forearm pads 7, and the feet on the foot station 14. The exerciser then focuses on pulling and shortening the abdominal muscles as the upper torso component 5 tilts at it's axis adjacent the middle lumbar and transverse the umbilical plane. The exercisers entire upper torso maintains postural alignment supported on the upper torso component 5 from head to lumbar. The arm component 8 being moved toward the exercisers lower body by the muscles of the upper body moves the upper torso component as it assist the abdominal muscles 5. When the exerciser reaches the limit of forward movement, he returns slowly and gradually to the starting position and repeats the exercise. It is preferred that a resistance weight be chosen such that it is easily manageable by the maximum strength of the exerciser. The exerciser does many reps and several sets until abdominal muscles are challenged beyond their capacity.

Thus the reader will see that the abdominal muscle exercise apparatus of the invention provides effective, safe, and ergonomically advanced abdominal exercise for the advanced as well as the novice exerciser.

CONCLUSIONS AND RAMIFICATIONS

While the above description contains many specificities, these should not be construed as limitations on the scope of the invention, but rather as an exemplification of one preferred embodiment thereof. Many other variations are possible. For example the means by which the muscles of the upper body assist the abdominal muscles could be very different including using a lever attached to a wheel rolling adjacent the bottom side of the upper torso engaging means. As the wheel rolls, the upper torso support is tilted from its axis. The axis of the arm component could be located substantially away from the preferred embodiment as shown and described. The size and shape of the upper body component, the hip component, and the lumbar component could vary widely. Further attempts to conform to the user's body by way of manipulating the size and shape of pads, support means, arm component, foot station and foothold are possible ramifications. Accordingly, the scope of the invention should be determined not by the embodiment illustrated, but by the appended claims and their legal equivalents.

That which is claimed is:

1. Apparatus comprising:

upper torso posterior support means mounted to base means, and first pivot means performing pivotal movement of said upper torso posterior support means about an axis extending transversely of said base means and generally adjacent the user's lumbar, and second pivot means located posterior to said upper torso posterior support means and transversely pivoted to said base means and having a distal end extended out of a lateral side of said base means, and upper body appendage engaging means respectively connected to the distal end of said second pivot means for utilizing upper body appendage strength for rotating said second pivot means, and actuating means operatively connected to said second pivot means and operatively connected to said upper torso posterior support means providing for said upper body appendage engaging means to actuate pivoting of said upper torso posterior support means, and hip posterior support means angled down and away in relation to plane of said upper torso posterior support means providing for the user's lumbar to be fully supported while arching prior to abdominal muscle contraction.

2. Apparatus according to claim 1 including separate lumbar posterior support means located between said hip support means and said upper torso posterior support means.

3. Apparatus according to claim 1 including feet anterior engaging means retaining the feet anteriorly and restricting upward foot movement during abdominal exercise.

4. Apparatus according to claim 1 including said second pivot means having two distal ends extended out of two opposite lateral sides of said base means.

5. Apparatus according to claim 1 including movement resisting force means for imposing resistance to movement of said upper torso posterior support means, and said movement resisting force means operatively connected to said upper torso posterior support means.

6. Apparatus according to claim 5 including variation means to said movement resisting force means for changing the amount of force imposed in predetermined increments.

7. Apparatus according to claim 1 wherein the apparatus supports the user in a generally seated position.

8. Apparatus according to claim 1 wherein said upper body appendage engaging means engage the user's hands.

9. Apparatus according to claim 1 wherein said upper body appendage engaging means engage the user's forearms.

10. Apparatus according to claim 1 wherein said upper body appendage engaging means engage the user's elbows.

11. Apparatus according to claim 1 wherein said upper torso posterior support means engage the user's head posteriorly.

* * * * *